US008671760B2

(12) United States Patent
Wallrath et al.

(10) Patent No.: US 8,671,760 B2
(45) Date of Patent: Mar. 18, 2014

(54) DRIVABLE DEVICE FOR COMPACTING A SOIL LAYER STRUCTURE AND METHOD FOR ASCERTAINING A LAYER MODULUS OF ELASTICITY OF AN UPPERMOST LAYER OF THIS SOIL LAYER STRUCTURE

(75) Inventors: Wolfgang Wallrath, Grenderich (DE); Hans-Josef Kloubert, Aachen (DE)

(73) Assignee: BOMAG GmbH, Boppard (DE)

( * ) Notice: Subject to any disclaimer, the term of this patent is extended or adjusted under 35 U.S.C. 154(b) by 206 days.

(21) Appl. No.: 13/300,879

(22) Filed: Nov. 21, 2011

(65) Prior Publication Data

US 2012/0134746 A1 May 31, 2012

(30) Foreign Application Priority Data

Nov. 26, 2010 (DE) ..... 10 2010 052 713

(51) Int. Cl.
*G01N 3/00* (2006.01)
*G01N 3/48* (2006.01)

(52) U.S. Cl.
USPC ..... 73/594; 73/584

(58) Field of Classification Search
USPC ..... 73/594, 84, 573, 584
See application file for complete search history.

(56) References Cited

U.S. PATENT DOCUMENTS 3,553,903 A * 1/1971 Christie ..... 451/5
5,025,150 A * 6/1991 Oldham et al. ..... 250/253
5,934,824 A * 8/1999 Vural ..... 404/117
5,952,561 A 9/1999 Jaselskis et al.
6,244,102 B1 * 6/2001 Novak ..... 73/84
6,431,790 B1 * 8/2002 Anderegg et al. ..... 404/75
6,551,019 B1 4/2003 Motz et al.
7,483,791 B2 * 1/2009 Anderegg et al. ..... 702/2
8,162,564 B2 * 4/2012 Potts et al. ..... 404/84.1

FOREIGN PATENT DOCUMENTS

DE 199 56 943 A1 5/2001

OTHER PUBLICATIONS

German Patent and Trademark Office, Search Report, Application No. 10 2010 052 713.0, mailed Jul. 20, 2011, 5 pages.

* cited by examiner

*Primary Examiner* — J M Saint Surin
(74) *Attorney, Agent, or Firm* — Wood, Herron & Evans, LLP

(57) ABSTRACT

The present invention relates to a drivable device for compacting a soil layer structure, having at least one vibration means or device, such as a vibration roller or a vibration plate, via which load pulses (P), which compact the soil layer structure, can be introduced into at least one load introduction area. At least one first and one second detection means or devices for detecting the modulus of elasticity of the soil layer structure are provided, which are situated spaced apart from one another on the drivable device in such a way that the first detection means or device allows a detection in the load introduction area and at least the second detection means or devices allows a detection outside the load introduction area. The present invention also relates to a method for ascertaining a layer modulus of elasticity.

15 Claims, 2 Drawing Sheets

DRIVABLE DEVICE FOR COMPACTING A SOIL LAYER STRUCTURE AND METHOD FOR ASCERTAINING A LAYER MODULUS OF ELASTICITY OF AN UPPERMOST LAYER OF THIS SOIL LAYER STRUCTURE

CROSS-REFERENCE TO RELATED APPLICATIONS

The present application claims priority under 35 U.S.C. §119 of German Patent Application No. 10 2010 052 713.0, filed on Nov. 26, 2010, the disclosure of which is hereby incorporated herein by reference in its entirety.

FIELD OF THE INVENTION

The present invention relates to a drivable device for compacting a soil layer structure, having at least one vibration means or device, such as a vibration roller or a vibration plate, via which load pulses which compact the soil layer structure can be introduced into at least one load introduction area.

In addition, the present invention relates to a method for ascertaining a layer modulus of elasticity of an uppermost layer of a soil layer structure, in particular a roadway asphalt layer, during a compaction procedure.

BACKGROUND OF THE INVENTION

Such drivable devices for compacting a soil layer structure are known from the prior art. For example, there are machine driven rollers, and in particular road rollers, by which a soil layer structure, and in particular an asphalt road including its substrate, can be compacted. For this purpose, the drivable devices and also the above-mentioned road roller have a vibration means or device, via which load pulses which compact the soil layer structure can be introduced into the surface of the soil layer structure.

The drivable device moves in multiple work steps over the soil layer structure to be compacted, a further compaction up to a maximum compaction being achieved upon each passage. After achieving the maximum compaction, further compaction of the soil layer structure is no longer necessary or is even counterproductive, because it results in renewed loosening of the compacted soil layer structure and excess strain of the compaction device. For this reason, it is important to detect the degree of compaction of the soil layer structure continuously or at specific intervals.

However, it is problematic in this case that because of the structure of the soil composed of different layers, precise detection of the moduli of elasticity of the respective layers, i.e., the layer moduli of elasticity, is only imprecisely possible, since the moduli of elasticity of the individual layers, in particular unbound layers, mutually influence one another.

A method using the so-called "falling weight deflectometer" (FWD) is known from the prior art, in which a relatively precise detection of a layer modulus of elasticity is possible by ascertaining a depression trough caused by a load pulse via an established number of detection devices. In particular, in the case of the evaluation of the carrying capacity of existing asphalt roads, the carrying capacity studies using the FWD are increasingly gaining significance. Using the FWD, a load pulse is applied to the road surface using a falling mass, which serves to simulate a wheel rollover. The briefly occurring vertical deformation of the surface of the soil layer structure is recorded in the load center and remotely at eight predefined distances from the load center.

The stiffness of the entire road structure is ascertained via the measured depressions of the depression trough. The influence of the deeper layers on the measured depressions increases with increasing distance from the load introduction point. This means that the depression at the load introduction point is a function of the carrying capacity of the entire layer structure, while the depression at the most remote pickup is essentially determined by the carrying capacity of the substrate or deeper layers. The calculation of the stiffnesses or the layer moduli of elasticity is then performed based on the theory of the elastic half-space and a multilayer model (e.g., a 2-layer or 3-layer model) according to Boussinesq/Odemark.

The modulus of stiffness at the load introduction point results in the so-called equivalent modulus, i.e., the modulus of elasticity of the entire soil layer structure under the influence of all layers. At the far remote measuring point, the so-called bedding modulus, the modulus of elasticity of the substrate, is ascertained. The moduli of elasticity of the individual layers are then ascertained by means of back calculation from the measured depression troughs or moduli of elasticity of the roadway. The layer thicknesses of the bound and unbound carrier layers are incorporated in the calculation.

However, this method has the disadvantage that the ascertainment of the layer moduli of elasticity using the FWD is very time-consuming and no further work can be performed on the soil layer structures during the measurement. The values obtained by the FWD are also only available to a soil compaction device, and in particular a road roller, after a time delay, so that a compaction-controlled method or the compaction-controlled soil compaction is only possible with difficulty.

SUMMARY OF THE INVENTION

The object of the present invention is therefore to specify a device for compacting a soil layer structure of the above-mentioned type, which allows the rapid and cost-effective detection or monitoring of a layer modulus of elasticity of the soil layer structure and in particular an uppermost layer.

This object is achieved according to one embodiment of the present invention by a drivable device for compacting a soil layer structure having at least one vibration means or device, such as a vibration roller or a vibration plate, via which load pulses, which compact the soil layer structure, can be introduced into at least one load introduction area, at least one first and one second detection means or devices being provided for detecting the modulus of elasticity of the soil layer structure, which are situated on the drivable device spaced apart from one another such that the first detection device allows a detection in the load introduction area and at least the second detection device allows a detection outside the load introduction area.

This object is achieved with respect to the method by a method for ascertaining a layer modulus of elasticity of a layer of a soil layer structure, in particular a roadway asphalt layer, having the following steps: introducing at least one load pulse into a load introduction area via a surface of the uppermost area of the soil layer structure; detecting a first value of a depression trough of the soil layer structure in the load introduction area by a first detection device, ascertaining the equivalent modulus of the soil layer structure from the detected first value of the depression trough; detecting at least one second value of the depression trough outside the load introduction area by at least one second detection device; ascertaining the bedding modulus and the layer modulus of elasticity of the uppermost layer of the soil layer structure from the detected values of the depression trough, the load pulses being introduced into the soil layer structure via a vibration means or device, such as a vibration roller or vibration plate, of a soil compaction machine.

An essential point is thus that, corresponding to the above-described FWD method, in the method according to the present invention or the drivable device according to the present invention, the vibration device provided for compacting soil layer structure, i.e., a vibration roller, a vibration plate, a vibration stamper, etc., is used as the load introduction means for initiating a defined load pulse.

In the scope of the present invention, a drivable device can be understood as any device which has operating means for soil compaction functioning as a vibration means or device and, in particular, which serves for mechanized planar soil compaction, in particular in construction operation. It is relevant that the drivable device is implemented so that the two detection means or devices for detecting the modulus of elasticity or for detecting a depression trough are situated spaced apart from one another so that the first detection device detects in the load introduction area while at least the second detection device detects outside this load introduction area. "Outside this load introduction area" is understood as any position in which the effect of the load pulse is detectable at a distance to a load introduction area.

As already described above, a deformation trough or a depression trough results through the load pulses introduced by the vibration means or device and, in particular, by a vibration roller in one embodiment.

Through the arrangement according to the present invention of the first and at least one second detection means, a conclusion about the individual layer moduli of elasticity and in particular a conclusion about the uppermost layer of the soil layer structure can be made via a targeted determination of the values of this depression trough.

The first detection device is preferably implemented in such a way that it allows a detection of a first value of a depression trough of the soil layer structure in the load introduction area, the second detection device preferably also being implemented in such a way that it allows a detection of at least one second value of the depression trough outside the load introduction area. A targeted determination of the respective layer modulus can then be performed via the values thus detected, as already described above.

The first detection means or device is preferably implemented and situated so that it allows a detection of a first value of the depression trough in the load introduction area. This first value allows the calculation of the equivalent modulus of the soil layer structure, i.e., the modulus of elasticity of the entire soil layer structure, since all deformations of the soil layer structure, from the uppermost layer to layers lying very far below it, influence it. In particular, it is possible to perform this detection during the soil compaction operation.

A further modulus of elasticity, namely the bedding modulus, can then be determined via at least the second detection means or device, which is situated outside the load introduction area or outside each load introduction area, so that it only detects effects of the load pulse of the compaction means. This ascertainment is also again performed via the detection of at least one value of the depression trough, namely at least the second value in the area of the second detection device. The bedding modulus can then be determined from at least this second value of the depression trough. The detection is also possible here during the soil compaction operation.

This bedding modulus is nearly independent of the substrate, since the deformation at this point is essentially only determined by the substrate and not by the uppermost layer, as already described. According to the theory of the multilayer model, the layer modulus of the uppermost layer and in particular the layer modulus of the asphalt layer is ascertained with the layer thicknesses of the individual layers of the soil layer structure. As an asphalt modulus which is corrected for the substrate influence, it represents the stiffness of the asphalt layer substantially more precisely than the equivalent modulus ascertained in the load introduction area.

By equipping a device for soil compaction with the detection means or device according to the present invention, monitoring of the compaction status, in particular a carrying capacity study of an asphalt road, can therefore also be performed during the compaction operation and in particular during the operation of a road roller or a comparable compaction means or device. The values thus ascertained can then directly influence the regulation procedures of the road construction machine, in order to achieve particularly effective control of the machine in accordance with demands.

The first and at least the second detection means or devices preferably have at least one geophone or similar deformation meter, via which reflected waves because of the introduced load pulses are detectable in particular in the soil layer structure. In this way, very precise detection of the respective values of the depression trough is possible.

The first and/or the second detection means or device preferably have a force sensor or a similar load cell, via which the introduced force pulses can be detected and/or relayed to a corresponding processing unit.

The detected force pulses are preferably stored in this processing unit. This is similarly true for the first and at least second values detected by the detection means, which are also preferably recorded, processed, and stored in a corresponding processing unit. The analysis of the detected values and the ascertainment of the respective moduli of elasticity are preferably possible in this analysis unit. It preferably also assumes the comparison of the ascertained equivalent and bedding moduli and the determination of the respective resulting layer modulus. Corresponding control and regulation programs as well as processing programs are preferably contained or storable for this purpose in the processing unit. The resulting results can then be displayed in a display unit and/or supplied to further program routines, such as the result-oriented regulation of the vibration means.

The first and at least second detection means or devices are preferably implemented so that they allow a precise detection of the deformations caused by the load introduction pulses in the respective areas. A detection can be performed using all methods and devices known from the prior art. It is thus also possible to perform a detection via the vibration means itself and by its settling movements during the vibration procedure. A very simple detection of the first and at least second values is possible, for example, by means of an electromechanical transducer implemented as a geophone, which converts the soil vibrations into analog voltage signals.

The detection means or devices are preferably situated so that a static coupling exists between the uppermost layer of the soil layer structure and the detection means.

In a particular embodiment, the first detection means or device is situated on the device in such a way that it allows a detection in the load center of the load introduction area. A maximum value can be ascertained as the first value of the depression trough in this way. The first detection device is preferably additionally situated coaxially to the load introduction axis of the vibration roller.

It is possible to situate the first detection means or device on the vibration roller or its bearing unit, in particular on a vibrating drum of the vibration roller. A precise detection of the first value in the load introduction area and in particular the load center of the load introduction area can be performed very simply in this way.

At least the second detection means or device is preferably situated on a static roller, in particular on the static drum thereof. A static roller is understood in the scope of the present invention as such a roller which does not have independent vibration means. Such a static roller can thus result in compaction of the soil solely because of its weight, for example, it can also only be used as the driving means for the drivable device according to the present invention. The term static roller thus also comprises rubber wheels or similar driving means in the scope of the present invention. The arrangement of the second detection means or device on a further non-vibrating, i.e., static suspension and in particular a static roller also allows the cost-effective and very precise detection of a second value of the depression trough. All methods for detecting the value in the depression trough known from the prior art can also be used here.

In an advantageous refinement, at least the second detection means or device is situated so it is displaceable, in particular via a support frame, in its position relative to the load introduction area of the vibration device. In this way, direct influence can be taken on the detection location of the second value of the depression trough. In addition, further detection means or devices for detecting further values of the depression trough outside the load introduction area can be situated on such a support frame. Moreover, of course, such further detection means or devices can also be situated on other components of the device, as long as they are spaced apart from the load introduction area.

The drivable device is preferably implemented as a compactor having a vibration roller and at least one static roller. A soil compaction with simultaneous carrying capacity study and in particular the detection of the carrying capacity status of the uppermost layer of the soil layer structure can then be performed very simply via a compactor equipped according to the present invention.

It is thus fundamentally possible by means of the drivable device according to the present invention and the method according to the present invention to perform a carrying capacity study, in particular of an uppermost layer of a soil layer structure, during a compaction process of a soil layer structure. A soil compaction machine, as is known from the prior art, is thus preferably equipped with the detection devices according to the present invention and further conversion and regulating units required for this purpose in order to perform a method similar to the method of the carrying capacity study using the "falling weight deflectometer". It is also possible in this context to offer a drivable device which allows a soil compaction machine to be equipped later with the above detection means or means for detecting a layer modulus of elasticity of an uppermost layer of a layer structure.

BRIEF DESCRIPTION OF THE DRAWINGS

The present invention is described hereafter on the basis of an exemplary embodiment, which is explained in greater detail through the appended drawings. In the schematic figures.

The same reference numerals are used hereafter for comparable and identically acting components, apostrophes sometimes also being used for differentiation.

DETAILED DESCRIPTION

Figure 1:
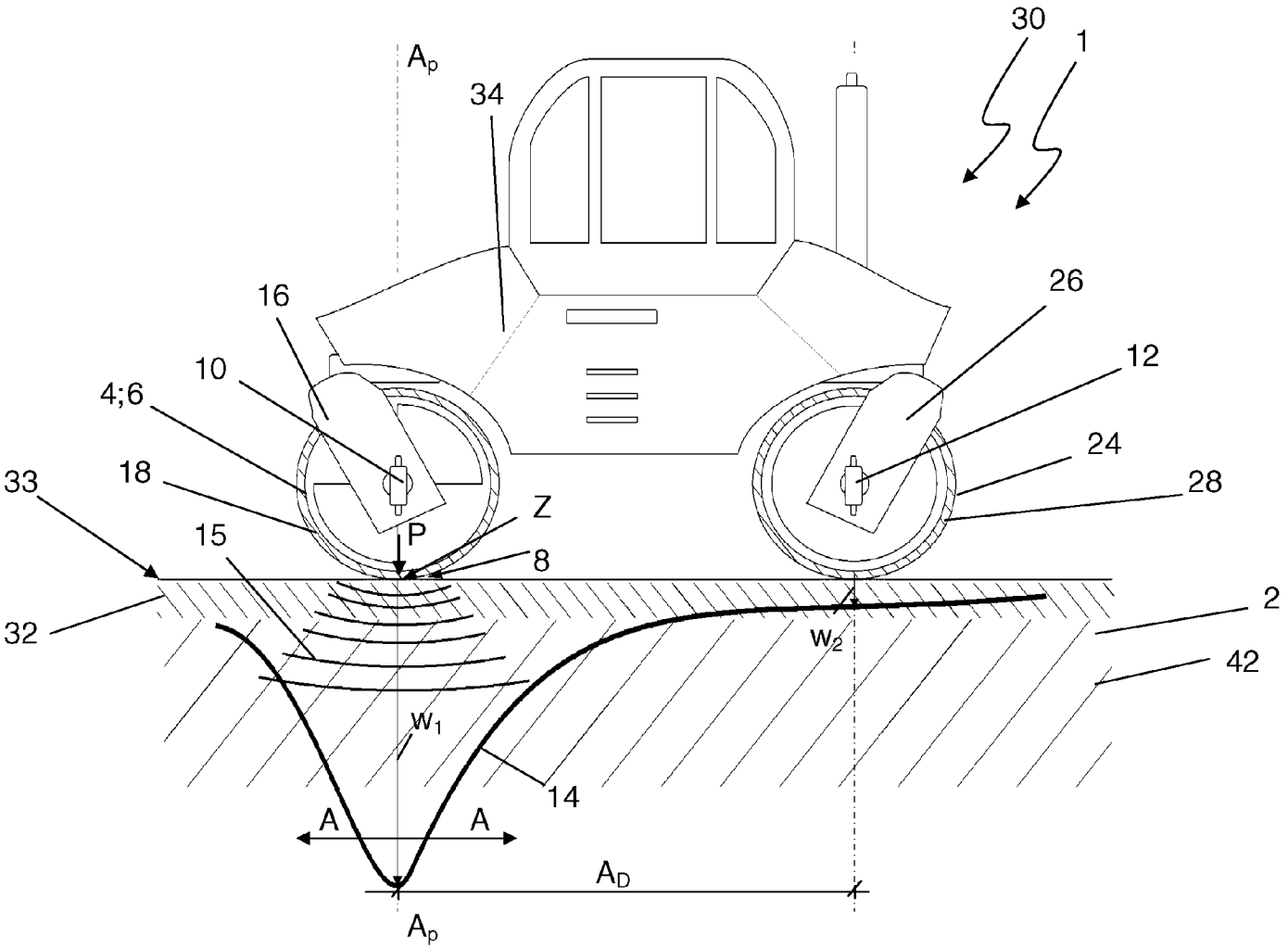
FIG. 1 shows an illustration of a first embodiment of the drivable device for compacting a soil layer structure.

FIG. 1 shows an illustration of an embodiment of a drivable device 1 according to the present invention for compacting a soil layer structure. The device 1 is implemented here as a self-propelled road roller and in particular as a compactor 30. It comprises a vibration means or device implemented as a vibration roller 6, which is connected via a bearing unit 16 to a main body 34 of the compactor 30. A static roller 24 is associated via a further bearing unit 26, so that the compactor 30 is drivable via the two rollers 6, 24.

In contrast to the static roller 24, in the case of which compaction of a soil structure 2 occurs exclusively because of its static weight, in the case of the vibration roller 6, the soil layer structure 2 can be actively compacted via driven vibrating masses.

The vibration roller 6 relays load pulses P via a load introduction area 8, which essentially corresponds to the contact area between the vibrating drum 18 of the vibration roller 6 and the surface 33 of the uppermost layer 32 of the soil layer structure 2, into the substrate. These vibrations, which are caused by the load pulses P and induce settling, are shown by the concentric circles 15 in FIG. 1.

Starting from a load center Z, settling in the soil layer structure 2, which is schematically shown here by the depression trough 14, occurs because of the introduced load pulses P and the resulting vibrations 15. It is clear in this case that the settling or compaction caused by the load pulses P decreases with increasing distance A from the load center Z or a load introduction axis $A_F$ running vertically to the surface 33.

A modulus of stiffness can be ascertained, as is known from the prior art, via the load pulses P introduced at the vibrating drum 18 or vibration roller 6, which act as compaction or deformation force in the soil layer structure 2. This modulus of stiffness corresponds to the equivalent modulus, i.e., a mean stiffness value over the entire measurement depth of the soil layer structure 2. Both the layer modulus of elasticity of the uppermost layer 32 and also of the bedding layers 42 lying underneath thus have influence on this equivalent modulus.

The detection of the first value "$w_1$" of the depression trough 14, required for ascertaining the equivalent modulus, is performed via a first detection means or device 10, which is situated and statically coupled in this embodiment on the vibration roller 6 or its bearing unit 16.

A second detection means or device 12, via which a second detection value "$w_2$" of the depression trough 14 can be ascertained outside the load introduction area 8, is situated on the static roller 24 or on its static drum 28 or its bearing unit 26. As is shown in FIG. 1, the second detection means 12 is spaced apart from the first detection means 10 and the load introduction area 8 in such a way that a detection of a modulus of elasticity of the layers situated below the uppermost layer 32 and in particular the bedding layer 42 is possible. Because of the distance $A_D$ between the first detection means or device 10 or the load introduction area 8 and the second detection means or device 12, the deformations at the detection point of the second value "$w_2$" are essentially determined by the substrate and not by the asphalt layer itself. A value of 1 m to 2.6 m, in particular 1.8 m, has proven to be an advantageous distance value $A_D$ here.

According to the theory of the multilayer model known from the prior art, the layer modulus of elasticity of the asphalt layer 32 to be measured can then be ascertained using the layer thicknesses of the individual soil layers via the two ascertained first and second values "$w_1$" and "$w_2$" and the equivalent or bedding moduli obtained therefrom, the result being an asphalt modulus which is essentially corrected for the substrate influence, and which represents the stiffness of the asphalt layer 32 significantly more precisely than the equivalent modulus, which considers the entire soil structure 2.

As a function of the components and detection means used, according to the present invention, a load introduction P can be performed at a frequency of 30 to 50 load introductions per second. A corresponding influence can be taken on the vibration means 4 or the vibration roller 6 here via corresponding control means. It is also possible to regulate the absolute value of the introduced load pulses via a corresponding regulation means in such a way that it corresponds to the required measuring conditions. For example, the load pulse P can be regulated to a value of 50 kN via the regulation means, which essentially corresponds to the wheel load of a truck and therefore allows an informative analysis of the carrying capacity of the soil layer structure 2 and in particular the upper layer 32. It is thus possible in this regard to activate the device 1 according to the present invention or the compactor 30 in such a way that it allows a reliable and reproducible study of the soil layer structure 2 and in particular the uppermost soil layer 32.

Figure 2:
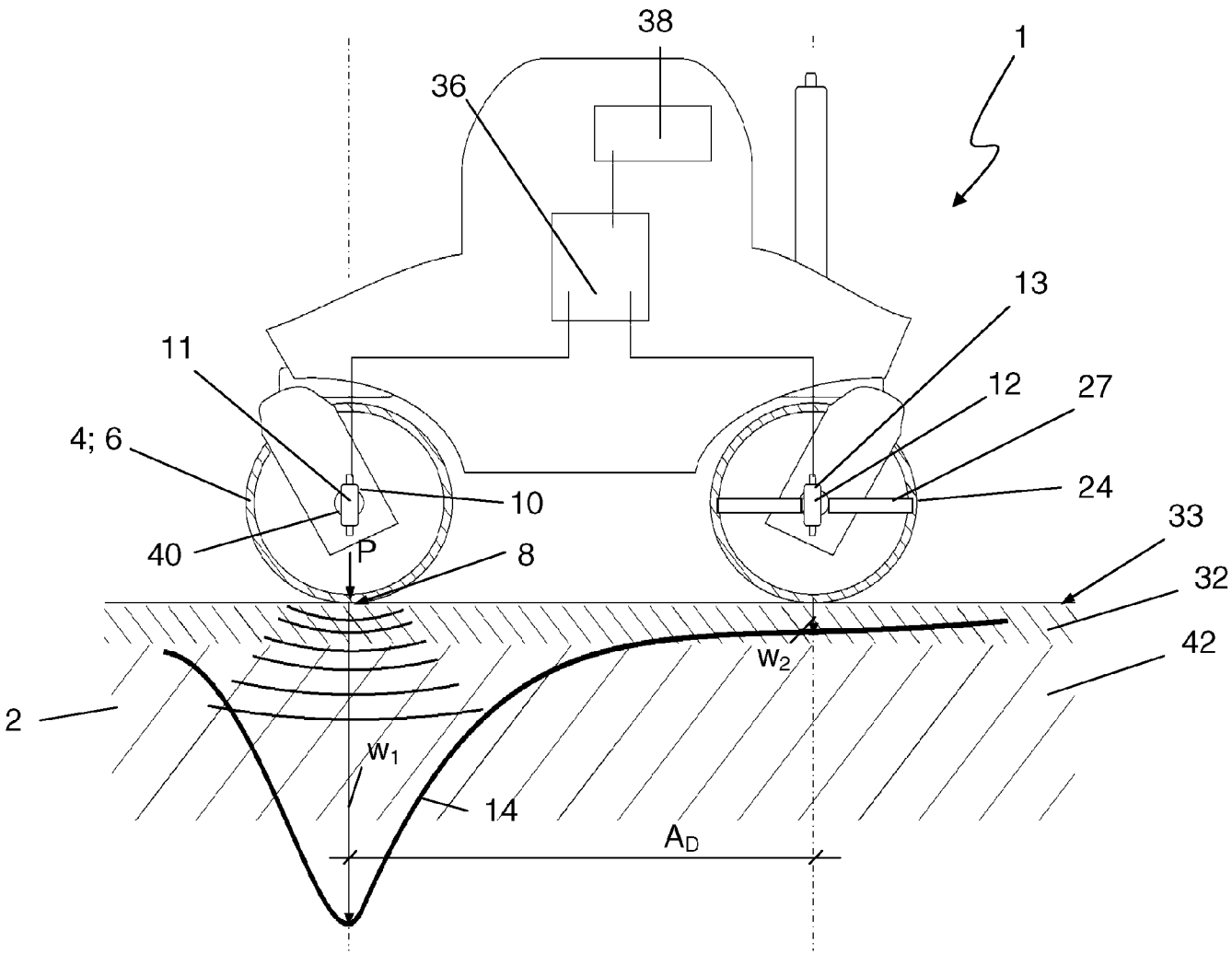
FIG. 2 shows an illustration of the detection means or device arrangement of the embodiment from FIG. 1.

FIG. 2 shows a schematic illustration of the drivable device 1 according to FIG. 1, showing the first and second detection devices 10 and 12.

It is shown that a geophone 11 of the first detection means or device 10 is situated on the vibration roller 6 of the drivable device 1 so that it allows detection of the reflected waves which are caused by the load pulses P. Via the geophone 11 or the first detection means or device 10, as is known from the prior art, the dynamic soil stiffness of the soil layer structure 2 located in the load introduction area 8 is thus detectable. Conclusions about the degree of compaction of the soil layer structure 2 may then be made in a known way via this dynamic soil stiffness.

A geophone 13 of the second detection means or device 12, is also situated on the static roller 24 of the drivable device 1. Since the static roller 24 does not introduce separate load pulses into the soil layer structure 2, this geophone allows a detection of a stiffness value as a function of the load introduction in the load introduction area 8, which, because of the distance $A_D$ between the two detection means or devices 10 and 12 or geophones 11 and 13, is essentially only a function of the bedding layer 42 and not the upper layer 32. Via the value "$w_2$" of the depression curve 14 detected by the geophone 13 or the second detection means or device 12, the soil stiffness and in particular a bedding modulus may therefore be determined without influence of the upper layer 32.

The first and second values "$w_1$", "$w_2$" ascertained by the two geophones 11, 13 are transmitted as measurement results to an analysis unit 36, which compares the two detected first and second values "$w_1$" and "$w_2$" or ascertains equivalent and bedding moduli of a layer modulus of elasticity of the uppermost layer 32 which can be ascertained therefrom. The values thus obtained can then either be output to the operating personnel via a display unit 38 or can directly influence the machine controller of the drivable device 1.

In addition, a calibration element 40 is shown in FIG. 2, via which, for example, the load pulses P introduced into the soil layer structure are fixable at a fixed value and in particular, for example, at a value of 50 kN. The vibration speed and therefore the number of load pulses per second is also preferably settable to a value between 20 and 50 times per second via such a calibration element 40.

A support frame 27 is also shown in FIG. 2, via which the second detection means or device 12 is situated so it is displaceable in its position relative to the load introduction area 8 of the vibration means or device 4 or the vibration roller 6 (preferably essentially parallel to the soil surface 32). As a result, the distance $A_D$ between the two measuring points of the values "$w_1$" and "$w_2$" is therefore variable via the support frame 27.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

The invention claimed is:

1. A drivable device for compacting a soil layer structure, comprising:

at least one vibration device configured to introduce load pulses (P) into at least one load introduction area for compacting the soil layer structure; and at least one first and one second detection devices for detecting the modulus of elasticity of the soil layer structure, wherein the first and second detection devices are situated spaced apart from one another on the drivable device in such a way that the first detection device allows a detection in the load introduction area and the second detection device allows a detection outside the load introduction area.

2. The drivable device according to claim 1, wherein the first detection device is configured to allow a detection of a first value $w_1$ of a depression trough of the soil layer structure in the load introduction area, and the second detection device is configured to allow a detection of a second value $w_2$ of the depression trough outside the load introduction area.

3. The drivable device according to claim 1, wherein the first and/or the second detection devices each has at least one geophone configured to detect reflected waves as a result of the load pulses (P) introduced into the soil layer structure.

4. The drivable device according to claim 1, wherein the first detection device is situated on the drivable device so as to allow a detection in a load center (Z) of the load introduction area.

5. The drivable device according to claim 1, wherein at least the second detection device is situated so as to be displaceable in its position relative to the load introduction area.

6. The drivable device according to claim 1, wherein the drivable device is implemented as a compactor having a vibration roller and at least one static roller.

7. The drivable device of claim 1, wherein the at least one vibration device comprises at least one of a vibration roller or a vibration plate.

8. The drivable device according to claim 7, wherein the vibration device is a vibration roller having a bearing unit and a vibrating drum, and further wherein the first detection device is situated on one of the bearing unit or the vibrating drum of the vibration roller.

9. The drivable device of claim 1, further comprising at least one static roller having a bearing unit and a static drum.

10. The drivable device according to claim 9, wherein at least the second detection device is situated on one of the bearing unit or the static drum of the static roller.

11. The drivable device of claim 1, further comprising a support frame, wherein at least the second detection device is situated so as to be displaceable, via the support frame, in its position relative to the load introduction area.

12. A method for ascertaining a layer modulus of elasticity of a layer of a soil layer structure during a soil compaction procedure, comprising:

introducing at least one load pulse (P) into a load introduction area via a surface of an uppermost layer of the soil layer structure;

detecting a first value ($w_1$) of a depression trough of the soil layer structure in the load introduction area via a first detection device, ascertaining an equivalent modulus of the soil layer structure from the detected first value ($w_1$) of the depression trough;

detecting a second value ($w_2$) of the depression trough outside the load introduction area via a second detection device, ascertaining a bedding modulus of the soil layer structure from the detected second value ($w_2$) of the depression trough;

ascertaining the layer modulus of elasticity of the uppermost layer of the soil layer structure from the two detected values ($w_1$, $w_2$) of the depression trough and the ascertained equivalent modulus or the bedding modulus, wherein the load pulse (P) is introduced via a vibration device of a soil compaction machine into the soil layer structure.

13. The method according to claim 12, wherein the detection of the first and second values ($w_1$, $w_2$) is performed during a soil compaction procedure of the soil layer structure.

14. The method of claim 12, wherein the layer of the soil layer structure is a roadway asphalt layer.

15. The method of claim 12, wherein the vibration device comprises at least one of a vibration roller or a vibration plate.

* * * * *